US006688216B2

(12) United States Patent
Olding

(10) Patent No.: US 6,688,216 B2
(45) Date of Patent: Feb. 10, 2004

(54) METHOD AND APPARATUS FOR ADJUSTING THE GIB-SLIDE CLEARANCE USING A PRESSURIZED CHAMBER COMBINATION

(75) Inventor: Michael J. Olding, Minster, OH (US)

(73) Assignee: The Minster Machine Company, Minster, OH (US)

( * ) Notice: Subject to any disclaimer, the term of this patent is extended or adjusted under 35 U.S.C. 154(b) by 63 days.

(21) Appl. No.: 09/875,647

(22) Filed: Jun. 6, 2001

(65) Prior Publication Data

US 2002/0185015 A1 Dec. 12, 2002

(51) Int. Cl.[7] ..... B30B 13/00

(52) U.S. Cl. ..... 100/35; 100/258 R; 100/269.17; 384/39

(58) Field of Search ..... 100/50, 48, 99, 100/214, 35, 258 R, 269.17, 240; 72/455; 384/39

(56) References Cited

U.S. PATENT DOCUMENTS 2,581,022 A * 1/1952 Japikse ..... 100/214
2,582,889 A 1/1952 Sedgwick
3,675,976 A 7/1972 Carrieri et al.
4,502,379 A 3/1985 Sato
4,794,781 A 1/1989 Shiga et al.
5,253,572 A * 10/1993 Uehara et al. ..... 100/271
5,285,722 A 2/1994 Schockman
5,909,705 A * 6/1999 Short et al. ..... 100/214
5,957,046 A * 9/1999 Nakabayashi et al. ..... 100/231
6,070,521 A * 6/2000 Otoshi ..... 100/280

* cited by examiner

*Primary Examiner*—Allen Ostrager
*Assistant Examiner*—Shelley Self
(74) *Attorney, Agent, or Firm*—Randall J. Knuth

(57) ABSTRACT

A feedback control system for use in a press machine is adapted to monitor and adjust the clearance between the gib and slide. A pressurized chamber, such as a hydraulic piston-cylinder combination is disposed in actuating relationship to the gib. Selective pressurization of the piston-cylinder induces a controlled displacement of the gib towards or away from the slide, thereby regulating the spatial relationship therebetween. A sensor provides a measure of any possible clearance between the gib and slide. The clearance measurement is compared to allowable reference data. A controller controls the pressurization of the chamber in accordance with the comparison results, thereby controllably moving the gib. The gib may be selectively displaced to optionally effectuate a minimal clearance condition.

40 Claims, 4 Drawing Sheets

METHOD AND APPARATUS FOR ADJUSTING THE GIB-SLIDE CLEARANCE USING A PRESSURIZED CHAMBER COMBINATION

BACKGROUND OF THE INVENTION

1. Field of the Invention

The present invention relates to a press machine environment, and, more particularly, to a system for monitoring the gib-slide interface to detect the presence of a clearance therebetween and to initiate a procedure for adjusting the clearance in a controlled manner, using a process that selectively pressurizes a pressurized chamber combination disposed in actuating relationship to the press gib.

2. Description of the Related Art

Mechanical presses of the type performing stamping and drawing operations have a conventional construction comprising a crown and a bed portion configured within a frame structure. A slide supported within the frame is adapted for reciprocating movement toward and away from the bed. The slide is driven by a crankshaft having a connecting arm coupled to the slide. These mechanical presses are widely used for a variety of workpiece operations employing a diverse array of die sets, with the press machine varying substantially in size and available tonnage depending upon its intended use.

In a conventional arrangement, the frame structure is formed and/or integrated with a gib apparatus having a known function and configuration. For example, in a typical machine configuration, the frame includes a set of upright support members (e.g., four) extending between the crown and bed at respective corner locations. Transverse crossbeams are used to provide a connection between a pair of same-side uprights. At the upper portion of each upright, a gib member is employed in a known manner to provide guidance-type bearing support to the slide. For example, the gib member includes an engagement surface that is adapted for full surface-to-surface abutting contact with a corresponding surface on the slide or a coupling piece secured to the slide.

In one gib configuration, the individual gib members are mounted to a respective upright. Although designed as stationary structures, the uprights may nevertheless experience an undesirable bending or outward bowing under certain conditions. For example, this bending may occur at the upper ends of the uprights as the crown expands in response to certain thermal conditions within the machine environment, such as significant variations or increases in temperature. These environmental factors are difficult to avoid and/or overcome because press operations inevitably involve a dynamic confluence of extremely high pressures and temperatures that make it difficult to isolate individual machine components from their effects, particularly with respect to a component as massive as the press crown. Temperature changes also effect the slide and bed.

The significance of this bending behavior of the upright is seen in the fact that the attached gib member will move in concert with the upright. In particular, any deflection of the upright causes a simultaneous displacement of the attached gib member, which necessarily rearranges the precise spatial relationship between the gib and slide. Under conditions where the upright bows outwardly (i.e., away from the slide), the concurrent movement of the gib will cause a spatial separation or clearance to develop at the interface between the gib and slide, where previously these components were in abutting engagement with one another in a bearing support relationship.

The absence or diminution in the bearing support provided by the gib to the slide can present various problems. For example, if the slide is inadequately supported, as may arise when certain gib elements experience movement creating an unbalanced support configuration, the slide may deviate from its planned course of travel as it reciprocates between the crown and bed. Malfunctions or misalignments involving the slide can lead to press failure and die damage.

SUMMARY OF THE INVENTION

An adjustment mechanism for use in a press machine environment is used to vary the spatial relationship between the slide and gib member mounted on the press upright. Adjustment of the gib-slide clearance is part of a compensation scheme aimed at counteracting the bowed or spatial change relative to the slide condition of the uprights that may arise from thermal expansion of the crown, bed, or slide portion, causing the clearance between the gib and slide to increase or decrease.

In one form of the invention, the gib is adapted to include a pressurized chamber, such as, for example a piston-cylinder combination contained within a receptacle area or housing space formed by the gib. A sensor measures a clearance between the gib and slide. A determination is made regarding whether this clearance measurement has exceeded an allowable threshold value. In response to an out-of-bounds determination, a controller injects pressurized oil into a pressurization chamber to create a directional actuating force which effectuates an inward or outward displacement of the gib toward the slide (e.g., via elastic bending of the gib). This gib movement counteracts the prior displacement of the gib resulting from bowing of the upright. The clearance between the gib and slide is therefore substantially restored to a normal condition, e.g., a minimal clearance condition.

The adjustment mechanism preferably forms part of an automated closed-loop feedback system that dynamically and continuously monitors the gib-slide clearance and appropriately regulates the pressurization level of the piston-cylinder combination in accordance with a comparison of the clearance measurement to allowable data values. Adjustment of the gib clearance preferably occurs during a running press cycle.

In another form, an adjustment mechanism comprises, in combination, a hydraulically activatable pressurized chamber, such as a piston-cylinder combination operatively associated with the gib, such piston-cylinder combination being responsive to changes in its pressurization to actuatively induce an elastic deformation of the gib sufficient to close-out the clearance between the gib and slide. The mechanism further includes a sensor to measure the gib-slide clearance, and a controller to vary the hydraulic pressurization according to the sensor clearance measurement. The system preferably defines an automated, closed-loop feedback configuration offering dynamic and continuous monitoring and adjustment of the gib-slide clearance.

The invention, in another form thereof, is directed to an assembly for use in a machine comprising a movable machine member and a frame to guide the movable machine member, wherein the frame includes a gib.

The assembly comprises at least one selectively pressurizable piston-cylinder combination each operatively associated with the gib, each piston-cylinder combination operatively actuating movement of at least a portion of the gib upon activation thereof. The assembly further includes a control system to control operation of the at least one piston-cylinder combination.

In one form, the cylinder of each respective piston-cylinder combination is defined at least in part by a respective portion of the gib. The frame preferably includes at least one upright support member, wherein each piston-cylinder combination is arranged to have one end of the cylinder thereof being disposed opposite a portion of a respective upright support member. Accordingly, during operation, at least one piston-cylinder combination is selectively activated to urge the respective piston against the respective upright support member associated therewith, thereby effectively inducing displacement of at least a portion of the gib at least towards the movable machine member.

In one form, the control system includes a sensor to provide a measure of the spatial relationship between the gib and the movable machine member; and a controller to control the pressurization of the at least one piston-cylinder combination, using the spatial measurement provided by the sensor. In a preferred form, the piston-cylinder combination and the control system cooperatively define a feedback configuration. The sensor spatial measurement preferably defines a possible clearance between at least one gib member and the movable machine member.

In one form, the machine includes a press, the movable machine member includes a slide, the press comprises a crown and a bed coupled together by the frame, the frame includes a plurality of upright support members extending between the crown and the bed, and the gib is coupled to the plurality of upright support members.

The invention, in another form thereof, is directed to a press comprising, in combination, a crown and a bed; a movable slide disposed for operative movement in opposed relation to the bed; a frame to guide operative movement of the slide; and a gib associated with the frame, the gib comprising at least one gib member. The press further includes at least one selectively pressurizable piston-cylinder combination, each piston-cylinder combination operatively associated with a respective gib member, each piston-cylinder combination acting to operatively displace at least a portion of the gib member associated therewith. A control system is provided to control operation of the at least one piston-cylinder combination.

In one form, the control system further includes a sensor to provide a measure of any possible clearance between at least one gib member and the slide. A comparator compares the spatial measurement provided by the sensor to allowable spatial data and provides a comparison signal representative thereof. A controller controls the pressurization of the at least one piston-cylinder combination based at least in part upon the comparison signal provided by the comparator.

The spatial measurement provided by the sensor is capable of defining a possible clearance between at least one gib member and the slide. The control system cooperating with the at least one piston-cylinder combination to effectuate a selective adjustment of any clearance measured by the sensor with respect to any ones of the at least one gib member.

The invention, in another form thereof, is directed to a system for use in a machine comprising a movable machine member and a frame to guide the movable machine member, wherein the frame includes a gib. The system includes, in combination, an actuator assembly adapted to operatively selectively displace at least a portion of the gib; and a control system to control operation of the actuator assembly.

In one form, the actuator assembly comprises at least one selectively operable piston-cylinder combination. In one implementation, each piston-cylinder combination is activatable by selective pressurization of a respective fluid chamber associated therewith.

In one form, the control system includes a sensor to provide a measure of the spatial relationship between at least one gib member and the movable machine member; and a controller to control the operation of the at least one piston-cylinder combination, using the spatial measurement provided by the sensor.

In a preferred form, the actuated displacement of the gib occurs relative to the movable machine member. More particularly, the actuated displacement of the gib is effective in substantially eliminating at least one possible pre-existing clearance between the gib and the movable machine member.

The invention, in another form thereof, is directed to an apparatus for use in a machine comprising a movable machine member and a frame to guide the movable machine member, wherein the frame includes a gib. The apparatus comprises, in combination, a piston-cylinder combination disposed for operative connection with the gib; and a control system operatively connected to the piston-cylinder combination.

In one form, the piston-cylinder combination has a selectively pressurizable fluid chamber. In one form, the control system further includes a hydraulic fluid supply operatively disposed in fluid communication with the fluid chamber of the piston-cylinder combination.

In one form, the cylinder of the piston-cylinder combination is defined at least in part by a respective housing area formed in the gib, wherein one end of the cylinder is disposed opposite a portion of an upright support member of the frame.

In another form, the control system further includes a sensor to provide a measure of the spatial relationship between the gib and the movable machine member, and a controller operatively connected to the sensor and operatively connected to the piston-cylinder combination. In a preferred form, the piston-cylinder combination and the control system cooperatively define a feedback configuration.

The invention, in yet another form thereof, is directed to a method for use in a press machine, the press machine comprising a crown, a bed, a movable slide, and a gib for use in guiding movement of the slide. The method comprises, in combination, the steps of determining a possible clearance between the gib and the slide; and displacing at least a portion of the gib, using the clearance determination.

In one form, the displacement step further comprises the steps of providing a piston-cylinder combination disposed for operative connection with the gib; and activating the piston-cylinder combination according to the clearance determination.

In one form, the activation step involves selectively hydraulically pressurizing the piston-cylinder combination.

The invention, in still yet another form thereof, is directed to a method of adjusting the position of a gib in a machine, the machine having a movable member. The method comprises, in combination, the steps of providing a piston-cylinder combination disposed for operative connection with the gib; and selectively activating the piston-cylinder combination to actuate displacement of at least a portion of the gib.

In one form, the activation step involves selectively hydraulically pressurizing the piston-cylinder combination.

In one form, the adjustment method further includes the steps of determining a possible clearance between the gib and the movable member; generating control information based at least in part upon the clearance determination; and utilizing the control information in the pressurization of the piston-cylinder combination.

One advantage of the present invention is that the gib-slide clearance can be automatically adjusted across a full range of adjustment values, namely, a partial reduction to a complete reduction (i.e., a full close-out that eliminates the clearance).

Another advantage of the invention is that the adjustment mechanism provides the machine operator with the automated ability to counteract or otherwise compensate for the unwanted gib displacement that occurs in conjunction with the thermally-induced expansion of the crown and accompanying bowing of the upright.

Another advantage of the invention is that the piston-cylinder implementation enables precise and reproducible control of the gib-slide clearance adjustments due to the selective management of the actuating process, namely, regulated pressurization of the piston-cylinder combination.

A further advantage of the invention is that management of the gib-slide clearance can be placed under the direction of a fully automated, closed-loop feedback configuration, which in one form employs a sensor to monitor the gib-slide interface and a controller to selectively pressurize the piston-cylinder to actuatively induce a corresponding movement of the gib.

A further advantage of the invention is that any mispositioning or dislocation of the gib members, originating from any cause or source, can be remedied by the adjustment mechanism.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
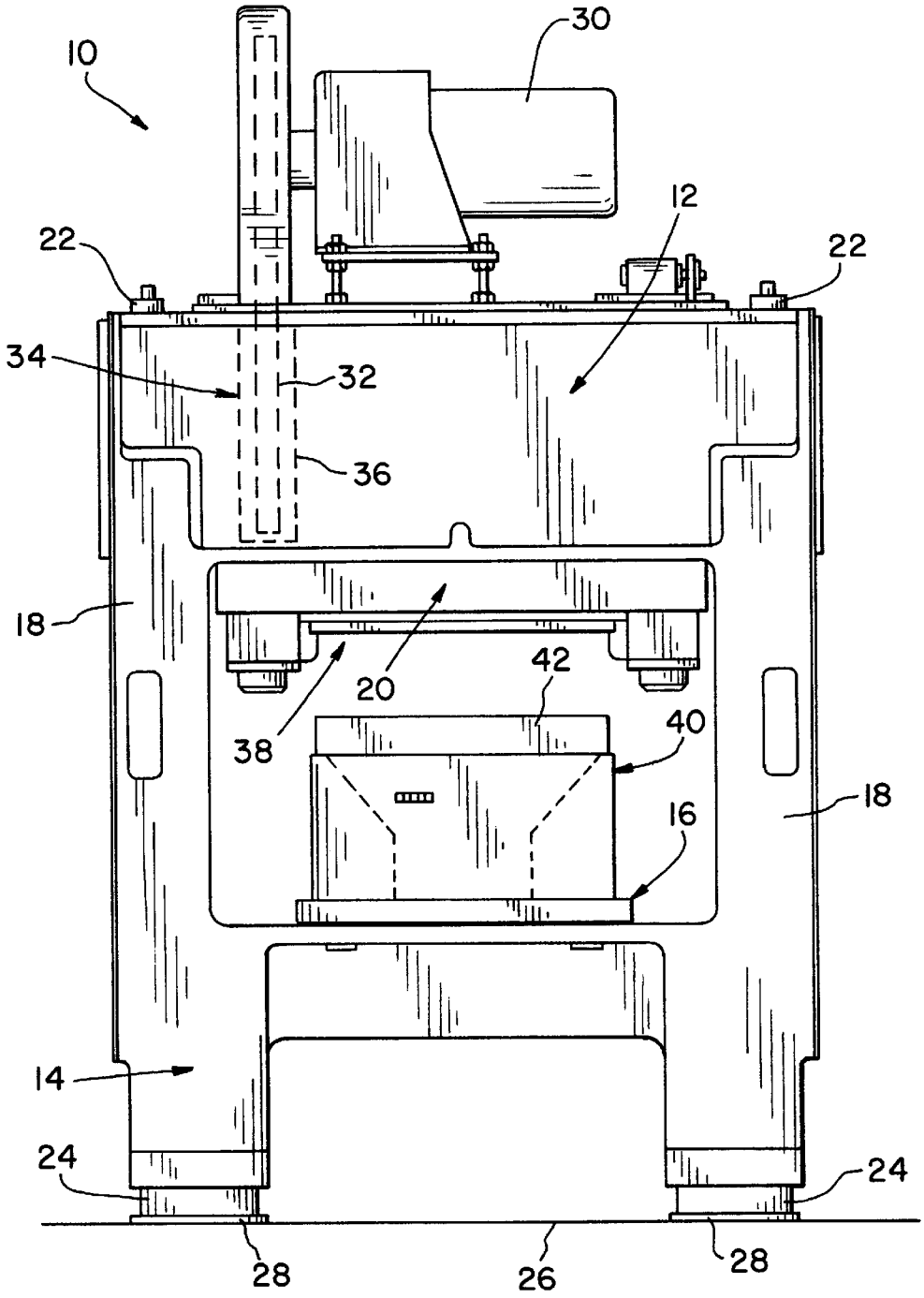
FIG. 1 is a front elevational view of a press machine in one illustrative form thereof incorporating the gib clearance adjustment assembly of the present invention.

The gib adjustment system of the present invention may be incorporated into machines of the mechanical press type discussed previously. Referring to FIG. 1, there is shown one such mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14.

Press machine 10 further includes an upper die shoe (referenced generally at 38) attached in a conventional manner to the lower end of slide 20. The upper die shoe 38 preferably includes a die element (not shown) attached thereto. A lower die shoe 40 having a die element 42 coupled thereto is attached in a conventional manner to the upper end of bolster 16. The upper and lower dies, as so arranged in their opposing spaced-apart relationship, cooperate in a known manner during press operation to process a workpiece disposed therebetween, e.g., mounted upon the lower die element 42. The upper and lower dies together constitute a die set or assembly. A plurality of guide posts (not shown) may be disposed between the upper die shoe 38 and lower die shoe 40 in a known manner.

Tie rods (not shown), which extend through crown 12, uprights 18 and bed portion 14, are attached at each end with tie rod nuts 22. Leg members 24 are formed as an extension of bed 14 and are generally mounted on shop floor 26 by means of shock absorbing pads 28. A drive motor 30, which is part of the press drive mechanism, is attached by means of a belt 32 to an auxiliary flywheel (referenced generally at 34) attached to crown 12. Auxiliary flywheel 34 is connected by means of a belt (not shown) to the main flywheel of the clutch/brake combination (depicted generally at 36).

Although press 10 is shown in a press-down configuration, it could alternately be constructed in a press-up configuration by arranging the press in an upside-down fashion. In this form, slide 20 would be connected to the lower unit instead of the upper unit, i.e., crown 12. If slide 20 is connected to the lower unit in such alternate press-up configuration, the lower unit would constitute the crown portion.

The form of the press machine shown in FIG. 1 is provided for illustrative purposes only, and therefore should not be considered in limitation of the present invention, as it should be apparent to those skilled in the art that the principles of the present invention may be practiced with, and incorporated into, various other machine configurations, including machine environments other than press applications.

Figure 2A:
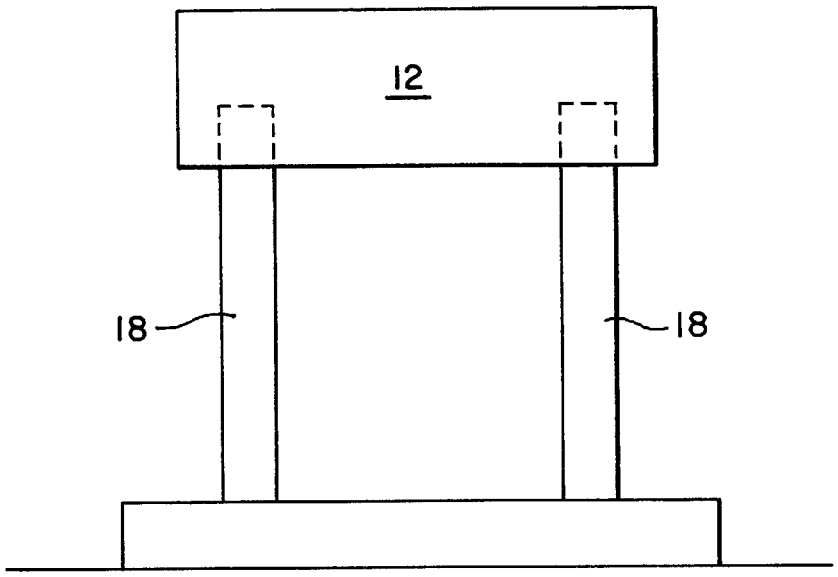
FIGS. 2A and 2B illustrate in exaggerated, front elevational view a partial schematic of two representative machine configurations that correspond to a normal frame condition (FIG. A) and a bent frame condition (FIG. 2B)
Figure 2B:
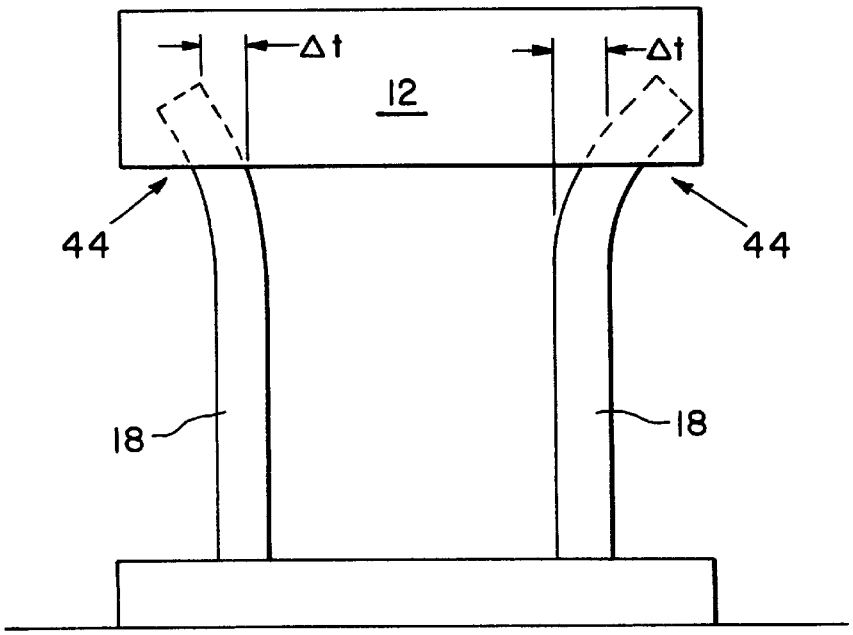

Reference is now made to FIG. 2 to discuss one of the problems addressed and overcome by the present invention. FIG. 2 depicts a pair of machine configurations in exaggerated, partial schematic view to illustrate a normal frame arrangement (FIG. 2A) compared with a misaligned frame arrangement (FIG. 2B). This misalignment or bending is attributable to thermal expansion of at least one of crown 12, slide 20, or bed 14 which causes the upper portions 44 of the upright support members 18 to bow outwardly in the indicated manner and thereby increase the clearance between the slide and the gib portion mounted to upright 18. The bowing feature is illustratively represented by a displacement "$\Delta t$" of upright support members 18 in the outward (i.e., lateral or side-to-side) direction from their normal orientation depicted in FIG. 2A.

This increase in the gib-slide clearance is detrimental because the gib provides the primary bearing support in accurately locating and guiding the slide during its operative reciprocating movement. If this guiding facility is diminished or otherwise impaired by displacement of the gib, the slide will lose the stable bearing support needed to ensure that the slide maintains the desired path of reciprocation. Any misalignment in the slide could cause damage to the dies or improper processing of the workpiece.

The present invention addresses and solves this problem by providing a gib control system that modifies any gib-slide clearance by displacing the gib relative to the slide, preferably in the direction that enables the clearance to be selectively adjusted to effect a full or partial close-out of the clearance. This modification of the gib-slide clearance should be understood as encompassing the full range of possible adjustments, namely, the clearance may be eliminated (full close-out) or reduced (partial close-out) in a selective manner.

In the event of a partial close-out, the adjusted clearance is preferably selected to satisfy an allowable clearance criteria. A partial close-out could be advantageous in situations where some clearance is desired to accommodate the formation of a hydrodynamic and/or hydrostatic bearing therein (i.e., between the gib and slide), especially bearings of the type that continuously circulate hydraulic fluid through the bearing location.

One advantageous implementation of the present invention involves integrating the gib adjustment mechanism into a closed-loop control system in which clearance measurements provided by a sensor are used as feedback to a system controller to enable continuous, dynamic monitoring and control of the gib-slide clearance.

Figure 3:
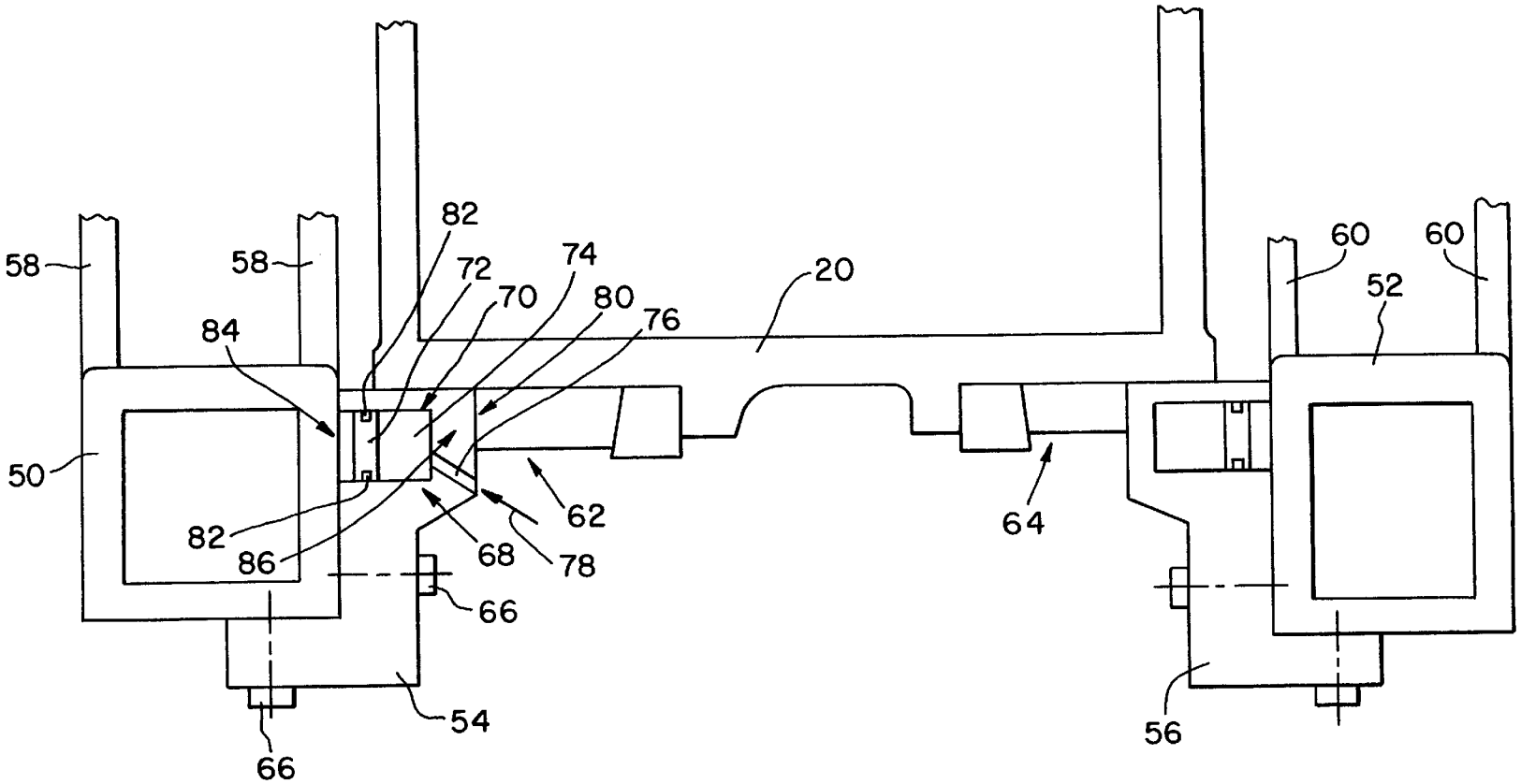
FIG. 3 is an upper, partial cross-sectional view of a press machine frame configuration having a gib structure adapted for integration with a piston-cylinder combination, in accordance with one embodiment of the present invention.

Turning now to embodiments of the present invention, reference is first made to FIG. 3 which illustrates a partial sectional view taken atop the press machine of the cooperative arrangement between the frame components and the slide, and the manner of adapting the gib according to one embodiment of the present invention.

The illustrated machine arrangement conventionally includes slide 20, a pair of back-end upright support members 50 and 52, and a pair of gib members 54 and 56 each mounted to respective uprights 50, 52 at upper portions thereof and providing bearing support to slide 20 in a conventional manner. The uprights 50, 52 are respectively connected via suitable transverse cross-beams or reinforcing members 58, 60 to similar upright support members located at the front-end of the press machine. This arrangement provides a conventional four-post frame structure that in combination with the gib structures serves to support and guide slide 20.

The gib members 54 and 56 are typically coupled to slide 20 using respective coupling or connection members 62 and 64, although each gib member 54, 56 may be arranged to provide direct abutting engagement with an integral bearing surface of the body of slide 20. Gib member 54 is illustratively mounted to upright 50 using a set of mounting bolts 66, although it should be apparent that this mounting may occur by any suitable means.

As used herein, a gib should be understood as encompassing any structure, formation, or arrangement that is provided (in whole or in part) for purposes including, but not limited to, bearing support, alignment, positioning, locating, guiding, load support, and framing.

For purposes of brevity, and not in limitation, the discussion below pertaining to gib member 54 applies equally to gib member 56 and any other gib member installed in the machine environment chosen to incorporate the principles of the present invention.

According to one embodiment of the present invention, gib member 54 is adapted for integration with a piston-cylinder combination 68 comprising a cylinder 70 and a piston 72. The cylinder 70 and piston 72 preferably define a variably pressurizable fluid chamber 74 arranged for fluid communication with a fluid line 76 providing hydraulic fluid 78. Seals 82 are used in a known manner to sealproof fluid chamber 74 and prevent hydraulic fluid from escaping past piston 72.

In one form, piston-cylinder 68 is constructed and configured such that cylinder 70 is defined by various suitable surfaces of gib 54. This manner of construction is guided by the requirement that piston-cylinder 68 will be able to operatively actuate movement of gib 54 in a direction that enables adjustment of the relevant gib-slide clearance.

For example, as shown, the sidewalls and one end surface of cylinder 70 are defined by respective surfaces of gib 54, thereby forming a cylindrical recess in gib 54 adequate to receive piston 72. In this construction, a portion of upright 50 (referenced generally at 84) defines another end surface immediately adjacent the open end of the cylindrical recess, whereby piston 72 is disposed in facing opposition to such portion of upright 50. Regardless of how cylinder 70 is formed or provided, the orientation of cylinder 70 vis-à-vis gib 54 is preferably chosen such that its longitudinal axis lies substantially parallel to the direction in which clearance adjustment is to take place.

Figure 4:
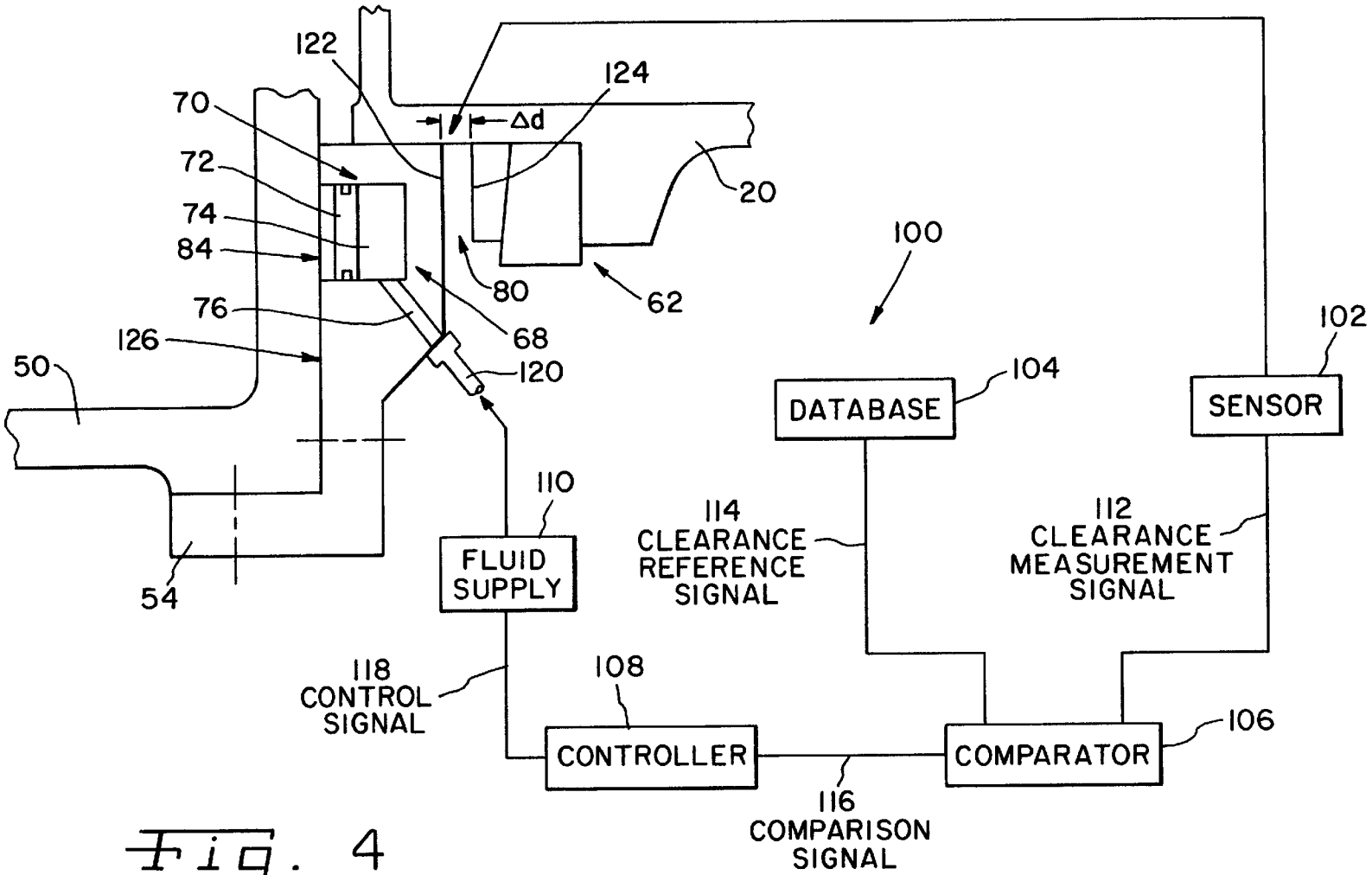
FIG. 4 is a partial sectional schematic, partial block diagram for illustrating an automatic, closed-loop clearance adjustment system, in accordance with another embodiment of the present invention.

For example, as discussed further in connection with FIG. 4, separation of gib 54 from slide 20 typically takes place at the interface illustratively referenced at 80, which in FIG. 3 corresponds to the junction where gib 54 is engaged to slide 20 via connection member 62. In the press machine, this separation typically occurs along a lateral or side-to-side dimension that produces a clearance (not shown) between gib member 54 and slide 20 (i.e., at connection member 62). Thus, the longitudinal axis of cylinder 70 is oriented to be substantially parallel to this separation direction. In FIG. 3, a typical gib-slide clearance would be created as the combination of upright 50 and gib 54 moves laterally (i.e., leftward) as upright 50 experiences a bowing activity in response to thermal variations affecting the attached press crown.

Accordingly, as discussed infra, once piston-cylinder 68 is activated by suitably pressurizing fluid chamber 74, the pressure-related force developed by piston-cylinder 68 will be applied in a known manner along the longitudinal direction of cylinder 70, thereby enabling adjustment of the gib-slide clearance via actuated displacement of gib 54 relative to slide 20, i.e., movement of gib 54 towards slide 20. In one form, as discussed further, this actuating force develops as piston 72 is urged against the facing portion of upright 50 in response to pressurization of fluid chamber 74. After completion of the gib-slide clearance adjustment, the pressurization of piston-cylinder 68 is maintained to hold the displaced gib 54 in its new orientation with slide 20. Further clearance adjustments can be made in the same manner via controlled changes in the pressurization of piston-cylinder 68.

The geometry of cylinder 70 may include any suitable cylindrical shape, e.g., circular or polygonal (e.g., rectangular). For this purpose, gib 54 may be specially manufactured to form the desired cylindrical formation or a conventional gib structure may be machined or otherwise processed to produce the required geometry of cylinder 70. Fluid line 76 is preferably formed as an interior passageway within gib 54, although any suitable means may be provided to supply fluid chamber 74 with pressurized fluid.

In one form, piston 72 is slidably disposed within cylinder 70. For this purpose, piston-cylinder 68 may be adapted to include a suitable biasing means of conventional form (e.g., springs) that locates piston 72 in a spaced-apart relationship to the facing portion of upright 50 during an idle or normal state, i.e., when piston-cylinder 68 is not activated. The biasing means would be adapted to enable piston 72 to move during activation (i.e., actuation-effective pressurization of piston-cylinder 68), but would act to restore piston 72 to its normal position within cylinder 70 when the pressurization is removed.

In another optional form, piston 72 is disposed for substantially continuous abutting engagement with the facing portion of upright 50, thereby avoiding the need for piston 72 to be brought into engagement with upright 50 from a spaced-apart orientation. No piston biasing means would therefore be needed.

During operation, piston-cylinder 68 is suitably pressurized in a controlled manner by injecting a regulatable amount of hydraulic fluid 78 into fluid chamber 74 via fluid line 76. The pressurization of piston-cylinder 68 is suitable to enable gib 54 to be displaced in a selective manner sufficient to adjust the gib-slide clearance to a desired degree, i.e., a full close-out (namely, a reduction that eliminates the existing clearance) or a partial close-out (namely, a reduction that leaves a selective amount of clearance).

In particular, during a clearance adjustment operation, selective pressurization of piston-cylinder 68 causes piston 72 to be forcibly urged against the facing portion of upright 50 in response to the pressure-related force developing in fluid chamber 74. This interaction between piston 72 and upright 50 occurs regardless of the particular implementation being used for piston 72, namely, whether piston 72 is initially disposed in abutting engagement with upright 50 or is slidably maneuvered into such engagement upon pressurization.

For purposes of operation, upright 50 is considered a stationary fixture relative to the cooperative interaction between piston 72 and upright 50, which occurs as piston 72 is forcibly urged against upright 50 in response to the pressurization of piston-cylinder 68. In particular, upright 50 responds to this application of pressure-related force by directing a similar pressure-related force in the opposite direction (i.e., rightward in FIG. 3) against piston-cylinder 68, which thereby is transmitted to gib 54 and actuates displacement of gib 54 in the rightward direction.

The mechanism of gib displacement can take various optional forms. For example, in one form, the displacement of gib 54 relative to slide 20 may be provided by a tensile activity (e.g., elastic bending) occurring within gib 54. For this purpose, it is at least necessary to enable a portion of gib 54 to experience a tensile effect. For example, in FIG. 3, at least the portion of gib 54 through which the actuating force principally acts (indicated representatively at 86) should be provided in a manner that enables the activation of piston-cylinder 68 to effectively induce a tensile effect in gib portion 86 sufficient to realize the desired clearance adjustment. Conventional manufacturing and fabrication processes can be utilized to form gib 54 with such a tensile-capable construction.

In general, such a gib portion 86 having tensile characteristics will overlap at least the dimensional axis along which clearance adjustment takes place. As shown, gib portion 86 is disposed between piston-cylinder 68 and slide connection members 62 along the direction of the gib-slide displacement path. It should be apparent that this tensile effect may occur in whole or in part within gib 54, as needed, depending upon the extent to which gib 54 needs to be displaced to effect the clearance adjustment.

It is preferable that the tensile activity occurs as an elastic deformation of gib 54 such that gib 54 can be substantially restored to its original form or any one of various intermediate conditions, in the event that the pressurization is completely or partially removed, such as when the bowing profile of upright 50 is eliminated or reduced, e.g., by cooling the crown.

In another optional form, gib 54 can be adapted to move in the absence of tensile activity, i.e., the gib movement is characterized by an intact, substantially rigid displacement in which substantially no gib deformation takes place. In this arrangement, gib 54 can be adapted to enable it to move in whole or in part under the influence of the actuating force developed using piston-cylinder 68. For example, if gib 54 is adapted to move as a unitary body, gib 54 would be slidably mounted on upright 50 in a manner enabling it to be slidably moved in the desired direction (e.g., side-to-side in FIG. 3).

Otherwise, a partial intact displacement of gib 54 could be accommodated by constructing gib 54 as a segmented assembly having an integrated arrangement of movable and stationary discrete gib elements. As a whole, the segmented gib assembly would move in unison with upright 50. The stationary gib elements would be fixedly secured to upright 50, while the movable gib elements would be slidably mounted to upright 50 or to a stationary gib element. One such movable gib element, for example, would encompass gib portion 86 in FIG. 3. The advantage this segmented approach offers is that deformation of the gib members can be avoided.

Of course, it should be understood that any combination of tensile-based and intact (i.e., non-deforming) displacement can be used with gib 54.

Although the piston-cylinder combination of FIG. 3 is shown in relationship to gib structures disposed at the upper portions of a pair of upright support members, this particular configuration is shown for illustrative purposes only and should not be considered in limitation of the present invention. Rather, it should be apparent that the actuation mechanism of the present invention (e.g., piston-cylinder combination) can be integrated with any gib structure positioned at any location relative to the slide. For example, if for some reason the gib-slide clearance dimension experiences unwanted variations at gib positions midway along the slide or even at the bottom of the slide path, the gib structures installed at these locations could be suitably adapted to incorporate the piston-cylinder combination shown herein to enable adjustment of the corresponding clearance.

Although the piston-cylinder arrangement shown in FIG. 3 is illustratively associated with the gib members attached to the back-end uprights, it should be apparent that a similar piston-cylinder arrangement could likewise be implemented with the gib members attached to the front-end uprights. This preferably results in an overall system configuration having a respective piston-cylinder combination dedicated to the corresponding upper gib member associated with each upright support member. In a four-post frame, there would then be two pairs of piston-cylinder combinations.

Moreover, as shown in FIG. 3, the piston-cylinder combinations are typically implemented in corresponding pairs disposed at opposing sides of the slide. The reason is that the thermally-induced, bowing-related clearance variations which require correction typically occur simultaneously at opposing sides of the slide. However, this opposing-side implementation should not be considered in limitation of the present invention, as it should be apparent that any number of such piston-cylinder combinations (or other such actuators) may be provided to produce any configuration suitable for adjusting the gib-slide clearance(s). For this purpose, a control system would be provided to suitably coordinate in multi-tasking fashion the concurrent operation of all the piston-cylinder combinations.

Referring now to FIG. 4, there is shown a partial sectional schematic, partial diagrammatic view illustrating a control system 100 for use in combination with piston-cylinder 68 (FIG. 3) to direct and otherwise manage a gib-slide clearance adjustment process, according to another embodiment of the present invention.

For purposes of illustration, control system 100 is explained in connection with the gib-slide clearance adjustment mechanism discussed in relation to FIG. 3, namely, piston-cylinder 68 and associated gib 54. It should be apparent, however, that control system 100 can be used with any other such adjustment mechanism of the present invention.

The illustrated control system 100 comprises a sensor 102, a database 104, a comparator 106, a controller 108, and a fluid supply 110. In one form, the overall operation of control system 100 involves selectively adjusting the clearance between gib 54 and slide 20 in response to and in accordance with a measure of the gib-slide clearance. As shown, this clearance appears at the interface 80 between gib 54 and slide 20 and is indicated representatively by spatial separation distance "Δd".

Sensor 102 may be provided in the form of any device or apparatus suitable for measuring or otherwise determining a clearance present at a gib-slide interface of interest, e.g., interface 80. In one form, sensor 102 is implemented with a suitable transducer that detects any clearance at interface 80 (e.g., Δd) and generates a gib-slide clearance measurement signal 112 representative of this measurement. Sensor 102 may be configured as a contact or non-contact type detector. Examples of such sensor 102 include, but are not limited to, limit switches, pressure switches, hall-effect sensors, and others. Although only one sensor 102 is shown, it should be understood that any number of sensors may be positioned throughout the press machine environment to measure any number of clearance variations occurring at various gib-slide interface locations.

In one form of the invention, it is possible for the gib-slide clearance adjustment to selectively involve a complete reduction in the clearance (i.e., a full close-out) and/or a partial reduction in the clearance (i.e., a partial close-out). In the event of a partial close-out, it is preferable that the as-adjusted clearance meets allowable clearance criteria or threshold requirements defining the range of permissible clearance values.

For this purpose, database 104 is provided to include data representing permissible values for the clearance measurements. This clearance data can be provided in a form that correlates various gib-slide interface locations with corresponding allowable clearance measurements. In one form, database 104 includes a programmable memory for storing predetermined clearance data that can be updated as needed with new or revised data. Additionally, such clearance data could also be provided by any one of various input devices, enabling an operator to key in clearance data as control system 100 is operating. Database 104 generates a clearance reference signal 114 representative of the allowable clearance value for the current gib-slide interface 80 being monitored or otherwise under observation.

Comparator 106 compares the clearance measurement signal 112 (received from sensor 102) with the clearance reference signal 114 (received from database 104) and generates a comparison signal 116 representative of this comparison operation. For example, comparison signal 116 could be representative of the difference between the sensor clearance measurement and the allowable clearance value.

If the clearance measurement exceeds the allowable clearance, this event is indicative of an out-of-bounds condition requiring adjustment of the gib-slide clearance by at least the amount of the calculated difference therebetween (or more if desired). If the clearance measurement falls below the allowable clearance, this event is indicative of an in-bounds condition that would not require adjustment of the gib-slide clearance.

Comparator 106 may be provided in any of various forms such as a microprocessor, general purpose computer programmed to perform the indicated comparison operation, and a dedicated processor. It should be apparent that any suitable combination of hardware, software, and firmware may be used to implement comparator 106. Additionally, any other evaluation or analysis facility may be provided that is adapted to evaluate and/or analyze the gib-slide clearance measurements. In general, the illustrated components of control system 100 may be implemented with any combination of suitable analog and/or digital devices.

Controller 108 receives the comparison signal 116 from comparator 106 and generates control information in accordance therewith. In particular, the generated control signal 118 is suitable for use in controlling the operation of fluid supply 110. The control functionality that generates control signal 118 is based upon the clearance evaluation information represented by comparison signal 116.

The illustrated fluid supply 110 is generally representative of any apparatus capable of generating a selective, variably pressurized hydraulic fluid flow. For example, fluid supply 110 may include a conventional arrangement comprising a source of hydraulic fluid, a variable hydraulic pump, and a controllable valve assembly cooperating with the pump to regulate the pressurizing flow of hydraulic fluid.

Fluid supply 110 is specifically adapted for use in facilitating the selective pressurization of fluid chamber 74 of piston-cylinder 68. In particular, fluid supply 110 is adapted in any conventional manner for fluid communication with fluid line 76 (and hence piston-cylinder fluid chamber 74) via any suitable coupling mechanism 120. Fluid supply 110 would clearly be adapted to both increase the pressurization level of fluid chamber 74 (i.e., via the injection of fluid) and decrease the pressurization level of fluid chamber 74 (i.e., via the removal of fluid).

Controller 108 directs the operation of fluid supply 110 in accordance with comparison signal 116 or any other suitable control signal. For example, when comparison signal 116 indicates that the current clearance measurement exceeds an allowable clearance value, the control signal 118 generated by controller 108 will facilitate the execution of a clearance adjustment operation which at least modifies the gib-slide separation so that the resulting clearance meets a permissible value. If the clearance measurement is acceptable, no clearance adjustment is necessary. The clearance adjustment operation takes place via suitable pressurization of piston-cylinder 68 by activation of fluid supply 110 in response to and in accordance with control signal 118.

In other forms of the invention, a full clearance close-out may be deemed the most acceptable option for establishing the steady-state spatial relationship between slide 20 and gib 54. In this case, the allowable clearance values stored in database 104 will be set to zero (0), so that comparison signal 116 embodies a representation of the detected spatial separation Δd.

In an alternate form accomplishing a full close-out, control system 100 may be provided in a form that eliminates or avoids the comparison operation, instead being adapted to simply transmit clearance measurement signal 112 to controller 108. Controller 108 would then generate a control signal 118 that would be effective in directing fluid supply 110 to pressurize piston-cylinder 68 in a manner sufficient to substantially completely eliminate the detected clearance Δd.

In one form of control system 100, the functionality of controller 108 and comparator 106 may be integrated together using a programmable logic controller (PLC). The PLC would be suitably programmed in a known manner to contain the control sequence adequate for producing the proper control signals in response to the evaluation of the clearance measurements.

The illustrated control system 100 is preferably implemented in the form of a dynamic, closed-loop feedback configuration for continuously monitoring, evaluating, and adjusting the gib-slide clearance. The detected clearance measurements would serve as feedback signals (i.e., inputs into system 100) that are processed and used to generate piston-cylinder pressurization control signals (i.e., outputs from system 100). This feedback configuration preferably functions in a fully automated fashion, enabling the gib-slide clearances to be adjusted automatically upon the occurrence and subsequent detection and analysis of such clearances.

Control system 100 can operate at any time and for any duration, but finds particular use during press machine operation, e.g., when a workpiece is being processed during a press running cycle. Control system 100 can be adapted to selectively monitor the clearance (i.e., obtain clearance measurements) at specified intervals, although the monitoring operation preferably runs continuously.

Control system 100 can optionally include a display or other suitable notification apparatus (not shown) that reports the clearance measurements and comparison results to the operator. Additionally, an interrupt mechanism (not shown) can be provided that deactivates, disables, or suspends machine operation in the event that the clearance measurement exceeds an alarm threshold indicating the onset or occurrence of a failure condition necessitating immediate termination of the press cycle.

During operation, in reference to the gib-slide separation condition shown in FIG. 4, sensor 102 detects the presence of gib-slide clearance "Δd" and generates signal 112 representative thereof. This clearance measurement (as represented by signal 112) is then evaluated, i.e., it is compared by comparator 106 to an allowable clearance value pertaining to gib-slide interface 80. For purposes of illustration, and not in limitation, it is assumed that a full clearance close-out is desired, i.e., the allowable clearance is zero (0) as supplied by database 104.

Controller 108 generates control signal 118 based upon comparison signal 116. This control signal 118 represents a command instruction that will be effective in facilitating a full close-out of the existing gib-slide clearance. In particular, control signal 118 directs fluid supply 110 to produce a hydraulic fluid flow that pressurizes fluid chamber 74 of piston-cylinder 68 to a level sufficient to accomplish the desired clearance adjustment.

More specifically, in response to the pressurization of fluid chamber 74, piston 72 is driven, urged or otherwise applied against a facing portion 84 of upright 50. This intimate interaction between stationary upright 50 and piston 72 actuates displacement of gib 54 away from upright 50 (i.e., in the rightward direction of FIG. 4). This actuated displacement of gib 54 continues until gib surface portion 122 abuttingly engages with slide surface portion 124 which is disposed in facing opposition thereto across the gap or clearance Δd. The pressurization of piston-cylinder 68 is thereafter maintained to hold gib 54 in its new closed-out orientation relative to slide 20.

For gib configurations where the gib members are fixedly mounted to upright 50, one consequence of displacing gib 54 in the indicated manner is that a gap, clearance or other such interstitial space typically appears along at least a portion of the interface 126 between gib 54 and upright 50. In the absence of any such gib displacement that accompanies adjustment of the gib-slide clearance, this gib-upright interface 126 is otherwise defined by a firm surface-to-surface abutting contact between respective portions of gib 54 and upright 50.

Although the present invention has been shown and described in conjunction with a mechanical press, this implementation should not be considered in limitation of the present invention as it should be apparent that the gib adjustment system has general applicability to other machine environments and industrial settings.

Additionally, although the present invention addresses the particular problem associated with the bowing activity experienced by the uprights, the present invention may clearly be used to facilitate modification of the gib-slide clearance regardless of the cause or manner in which such clearance became present.

Additionally, although the present invention is depicted in a configuration where the gib is displaced relative to the slide to effect adjustment of the clearance therebetween, it should be understood that the present invention may be extended to other uses involving adjustment of the clearance between the gib and any other machine component, whether stationary or movable.

Additionally, even though the illustrated piston-cylinder combinations are used to make clearance adjustments in the lateral direction, this should not be considered a limiting feature of the present invention. Rather, it should be apparent that the piston-cylinder combinations (and any other suitable actuator mechanisms) may be suitably configured to enable gib-slide clearance adjustments to be made in any direction, e.g., longitudinal (up-and-down), lateral (side-to-side), transverse (front-to-back), cross-wise, and diagonal. In general, a gib-slide clearance adjustment can be made anywhere that a gib member is used.

Furthermore, although the present invention has been directed to a mechanism for selectively displacing a gib, this feature is simply illustrative and should not be considered in limitation of the present invention, as it should be apparent that the adjustment mechanism (e.g., piston-cylinder combination) may be readily adapted for use in actuating the movement of parts and components other than a gib. For example, other structures that may be adapted for movement may include, but are not limited to, support structures, bearing members, frame elements, and other similar arrangements that serve to position, locate, guide, support, frame, and align.

Additionally, although the embodiments of the present invention have used a piston-cylinder combination as the preferred actuating mechanism to effect displacement of the gib, the invention is not so limited but should be considered as broadly encompassing any suitable actuator apparatus that can be adapted for use in selectively displacing a certain machine element. For example, other actuator apparatus may include, but are not limited to, pressurized cavity (tubing) motorized or mechanical adjustment (e.g., servomotor).

Additionally, although the piston-cylinder combination disclosed herein is preferably of the type that is activated by hydraulic pressurization of a fluid chamber defined therein, this configuration should not be considered in limitation of the present invention as it should be apparent that any suitable piston-cylinder combination may be used with similar effectiveness. For example, other piston-cylinder combinations may be provided that are based upon activation principles that include, but are not limited to, electronic activation, electro-mechanical activation, and strictly mechanical driving activation.

Moreover, although the piston-cylinder combination disclosed herein is formed using a portion of the gib to define one of its features (i.e., the cylindrical surfaces), this configuration should not be considered in limitation of the present invention as it should be apparent that any suitable piston-cylinder combination may be adapted for use with the gib.

For example, it is possible to use a piston-cylinder combination that exists as a discrete module separately formed and otherwise constructed independently of the gib. For this purpose, the piston-cylinder combination would be suitably configured to enable operative connection with the gib such that activation of the piston-cylinder combination will actuate selective movement of the gib, i.e., produce a corresponding displacement of the gib.

For example, in one illustrative configuration, the piston may be fixed in position as a stationary piece while the cylinder is movable in response to changes in the pressurization of the fluid chamber formed therebetween. In this manner, the cylinder would be arranged for coupling to the gib such that movement of the cylinder will actuate a corresponding displacement of the gib.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An assembly for use in a machine comprising a movable machine member and a frame to guide the movable machine member, the frame including a gib, said assembly comprising:

at least one selectively pressurizable chamber combination each operatively configured within said gib, each chamber combination operatively selectively actuating movement of at least a portion of said gib one of toward and away from the frame upon activation thereof; and a control system to control operation of said at least one chamber combination.

2. The assembly as recited in claim 1, wherein the chamber of each respective chamber combination is a piston-cylinder combination being defined at least in part by a respective portion of said gib.

3. The assembly as recited in claim 2, wherein said frame including at least one upright support member, each piston-cylinder combination being arranged to have one end of the cylinder thereof being disposed opposite and substantially perpendicular to a portion of a respective upright support member.

4. The assembly as recited in claim 3, wherein during operation, at least one piston-cylinder combination being selectively activated to urge the respective piston against the respective upright support member located relative thereto and thereby effectively induce displacement of at least a portion of the gib at least towards said movable machine member.

5. The assembly as recited in claim 1, wherein said control system further comprises:

a sensor to provide a measure of the spatial relationship between said gib and said movable machine member; and a controller to control the pressurization of said at least one combination, using the spatial measurement provided by said sensor.

6. The assembly as recited in claim 1, wherein said at least one combination and said control system cooperatively defining a feedback configuration.

7. The assembly as recited in claim 1, wherein said gib including at least one gib member, each gib member having a respective said chamber combination located therein.

8. The assembly as recited in claim 7, wherein a portion of said each gib member defines at least in part the chamber of the respective said chamber combination located therein.

9. The assembly as recited in claim 7, wherein said control system further comprises:

a sensor to provide a measure of the spatial relationship between at least one gib member and said movable machine member; and a controller to control the pressurization of said at least one piston-cylinder combination, using the spatial measurement provided by said sensor.

10. The assembly as recited in claim 9, wherein the spatial measurement provided by said sensor being capable of defining at least in part a possible clearance between at least one gib member and said movable machine member.

11. The assembly as recited in claim 10, wherein said control system cooperating with said at least one piston-cylinder combination to effectuate a selective adjustment of any clearance measured by said sensor with respect to at least one said gib member.

12. The assembly as recited in claim 1, wherein said machine includes a press, said movable machine member includes a slide, said press comprises a crown and a bed coupled together by said frame, said frame including a plurality of upright support members extending between said crown and said bed, said gib coupled to said plurality of upright support members.

13. The assembly as recited in claim 1, wherein said control system being adapted to perform control of said at least one chamber combination at least one of prior to press running and during press running.

14. A press, comprising:

a crown and a bed;

a movable slide disposed for operative movement in opposed relation to said bed;

a frame to guide operative movement of said slide;

a gib associated with said frame, said gib comprising at least one gib member;

at least one selectively pressurizable piston-cylinder combination, each piston-cylinder combination operatively configured within a respective gib member, each piston-cylinder combination acting to operatively selectively displace at least a portion of the respective gib member one of toward and away from said frame; and a control system to control operation of said at least one piston-cylinder combination.

15. The press as recited in claim 14, wherein said control system further comprises:

a sensor to provide a measure of any possible clearance between at least one gib member and said slide;

said control system comprising a functionality to enable adjustment of any clearance sensed by said sensor, according at least in part to the clearance measurement provided by said sensor.

16. The press as recited in claim 14, wherein said control system further comprises:

a sensor to provide a measure of the spatial relationship between at least one gib member and said slide;

a comparator to compare the spatial measurement provided by said sensor to allowable spatial data and to provide a comparison signal representative thereof; and a controller to control the pressurization of said at least one piston-cylinder combination based at least in part upon the comparison signal provided by said comparator.

17. The press as recited in claim 16, wherein the spatial measurement provided by said sensor being capable of defining at least in part a possible clearance between at least one gib member and said slide.

18. The press as recited in claim 17, wherein said control system cooperating with said at least one piston-cylinder combination to effectuate a selective adjustment of any clearance measured by said sensor with respect to at least one said gib member.

19. The press as recited in claim 14, wherein a portion of said each gib member defines at least in part the cylinder of the respective piston-cylinder combination configured therewithin.

20. The press as recited in claim 19, wherein said frame including a plurality of upright support members, each gib member being located adjacent a respective upright support member, each piston-cylinder combination being adapted to have one end of the cylinder thereof being disposed opposite and substantially perpendicular to a portion of the respective upright support member.

21. The press as recited in claim 20, wherein during operation, at least one piston-cylinder combination being selectively pressurized to urge the respective piston against the respective upright support member and thereby induce displacement of at least a portion of the respective gib member at least towards said slide.

22. A system for use in a machine comprising a movable machine member and a frame to guide the movable machine member, the frame having a gib mounted thereto, said system comprising:

an actuator assembly adapted to operatively selectively displace at least a portion of said gib one of toward and away from the frame; and a control system to control operation of said actuator assembly.

23. The system as recited in claim 22, wherein said control system further comprises:

a sensor to provide a measure of any possible clearance between at least one gib member and said movable machine member;

said control system comprising a functionality to enable adjustment of any clearance sensed by said sensor, according at least in part to the clearance measurement provided by said sensor.

24. The system as recited in claim 22, wherein said actuator assembly comprises:

at least one selectively operable piston-cylinder combination.

25. The system as recited in claim 24, wherein each piston-cylinder combination being activatable by selective pressurization of a respective fluid chamber defined thereby.

26. The system as recited in claim 24, wherein said gib further comprises at least one gib member, each piston-cylinder combination being operatively configured within a respective gib member, the cylinder of each respective piston-cylinder combination being defined at least in part by a portion of the respective gib member.

27. The system as recited in claim 24, wherein said control system further comprises:

a sensor to provide a measure of the spatial relationship between at least one gib member and said movable machine member; and a controller to control the operation of said at least one piston-cylinder combination, using the spatial measurement provided by said sensor.

28. The system as recited in claim 22, wherein the actuated displacement of said gib at least occurring relative to said movable machine member.

29. The system as recited in claim 28, wherein the actuated displacement of said gib being effective in substantially eliminating at least one possible pre-existing clearance between said gib and said movable machine member.

30. An apparatus for use in a machine comprising a movable machine member and a frame to guide the movable machine member, the frame including an upright support member and a gib positioned adjacent thereto, said apparatus comprising:

a piston-cylinder combination operatively disposed within said gib, said piston of said piston-cylinder combination being configured for being selectively activated into direct biasing contact with said upright support member; and a control system operatively connected to said piston-cylinder combination.

31. The apparatus as recited in claim 30, wherein said piston-cylinder combination having a selectively pressurizable fluid chamber.

32. The apparatus as recited in claim 31, wherein said control system further comprises:

a hydraulic fluid supply operatively disposed in fluid communication with the fluid chamber of said piston-cylinder combination.

33. The apparatus as recited in claim 30, wherein the cylinder of said piston-cylinder combination being defined at least in part by a portion of said respective gib, one end of the cylinder being disposed opposite and substantially perpendicular to a portion of said upright support member of said frame.

34. The apparatus as recited in claim 30, wherein said control system further comprises:

a sensor to provide a measure of the spatial relationship between said gib and said movable machine member; and a controller operatively connected to said sensor and operatively connected to said piston-cylinder combination.

35. The apparatus as recited in claim 30, wherein said piston-cylinder combination and said control system cooperatively defining a feedback configuration.

36. A method for use in a press machine, said press machine comprising a crown, a bed, a movable slide, and a gib for use in guiding movement of said slide, said method comprising the steps of:

determining a possible clearance between said gib and said slide; and displacing at least a portion of said gib selectively one of toward and away from said slide, using the clearance determination, wherein the displacement step further comprises the steps of:

providing a piston-cylinder combination operatively disposed within said gib; and activating the piston-cylinder combination according to the clearance determination.

37. The method as recited in claim 36, wherein the activation step further comprises the steps of:

selectively hydraulically pressurizing the piston-cylinder combination.

38. A method of adjusting the position of a gib in a machine, said machine having a movable member, said method comprising the steps of:

providing a piston-cylinder combination operatively disposed within said gib; and selectively activating the piston-cylinder combination to actuate displacement of at least a portion of said gib.

39.The method as recited in claim 38, wherein the activation step further comprises the steps of:

selectively hydraulically pressurizing the piston-cylinder combination.

40. The method as recited in claim 39, further comprises the steps of:

determining a possible clearance between said gib and said movable member;

generating control information based at least in part upon the clearance determination; and utilizing the control information in the pressurization of the piston-cylinder combination.

* * * * *